US006926377B2

(12) United States Patent
Lammens et al.

(10) Patent No.: US 6,926,377 B2
(45) Date of Patent: Aug. 9, 2005

(54) DRAWER SLIDE LATCH AND RELEASE MECHANISM

(75) Inventors: Arthur E. Lammens, Fullerton, CA (US); Samuel Jurja, Kitchener (CA)

(73) Assignee: CompX International Inc., Mauldin, SC (US)

( * ) Notice: Subject to any disclaimer, the term of this patent is extended or adjusted under 35 U.S.C. 154(b) by 55 days.

(21) Appl. No.: 10/637,189

(22) Filed: Aug. 8, 2003

(65) Prior Publication Data

US 2004/0080245 A1 Apr. 29, 2004

Related U.S. Application Data

(60) Provisional application No. 60/401,906, filed on Aug. 8, 2002.

(51) Int. Cl.[7] ..... A47B 88/00

(52) U.S. Cl. ..... 312/333; 312/334.46; 384/21

(58) Field of Search ..... 312/333, 334.44, 312/334.45, 334.46, 334.47; 384/21

(56) References Cited

U.S. PATENT DOCUMENTS

| | | | | |
|---|---|---|---|---|
| 3,033,638 A | * | 5/1962 | Tomlinson | 312/334.8 |
| 5,169,238 A | * | 12/1992 | Schenk | 384/21 |
| 6,126,255 A | * | 10/2000 | Yang | 312/334.46 |
| 6,238,031 B1 | * | 5/2001 | Weng | 312/333 |
| 6,367,899 B1 | | 4/2002 | Hwang et al. | |
| 6,373,707 B1 | * | 4/2002 | Hutchins | 312/333 |
| 6,375,290 B1 | | 4/2002 | Lin et al. | |
| 6,412,891 B1 | | 7/2002 | Liang et al. | |
| 6,554,379 B2 | * | 4/2003 | Devine | 312/333 |
| 2002/0021061 A1 | | 2/2002 | Lammens et al. | |

FOREIGN PATENT DOCUMENTS

| | | | | |
|---|---|---|---|---|
| DE | 4210017 | * | 10/1992 | 312/334.44 |
| EP | 0107525 | * | 5/1984 | 312/333 |

* cited by examiner

*Primary Examiner*—Lanna Mai
*Assistant Examiner*—Hanh V. Tran
(74) *Attorney, Agent, or Firm*—Banner & Witcoff, Ltd.

(57) ABSTRACT

A drawer slide includes a first slide channel telescopically mounted for longitudinal movement in a second slide channel. The first channel includes a cantilever spring latch which engages the second slide channel when the first slide channel is extended to a fully telescoped position associated with a fully open drawer supported by the first channel. The first slide channel further includes a longitudinally movable manual release lever, which is slidable to engage and release the spring latch and thus allow the first channel to be slidably translated into the second channel thereby allowing the attached drawer to be moved to the closed position. The first slide channel further includes a second cantilever spring latch that limits the opening movement of the first channel. Both spring members may be released by an auxiliary release lever.

4 Claims, 4 Drawing Sheets

FIG.8
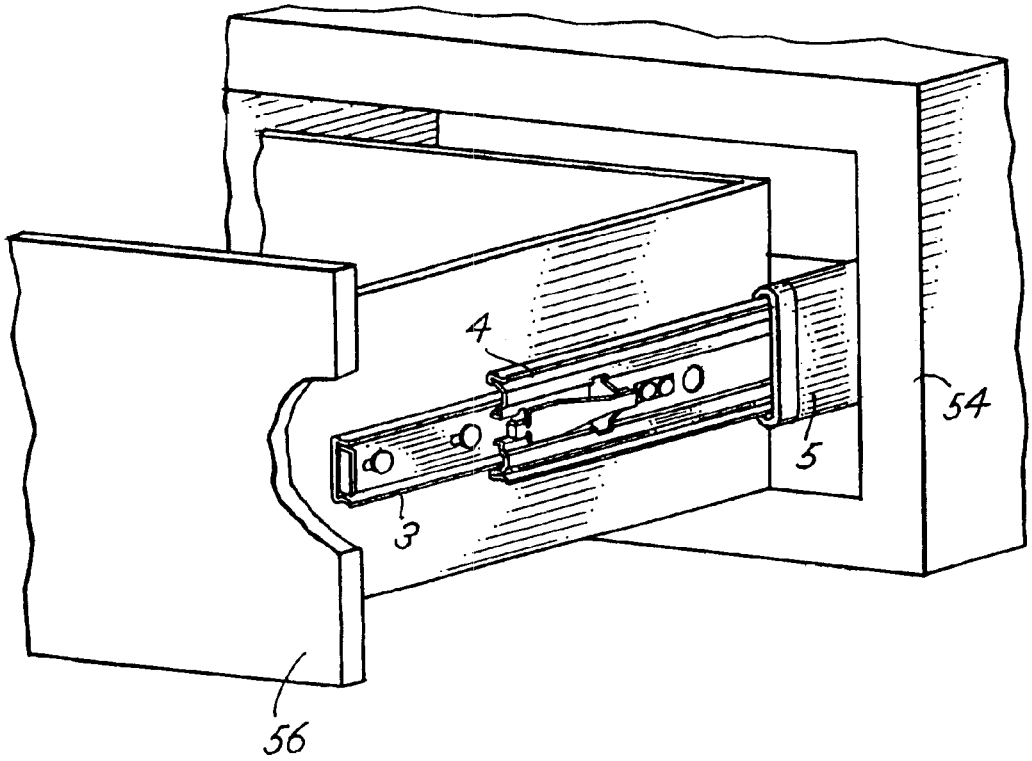
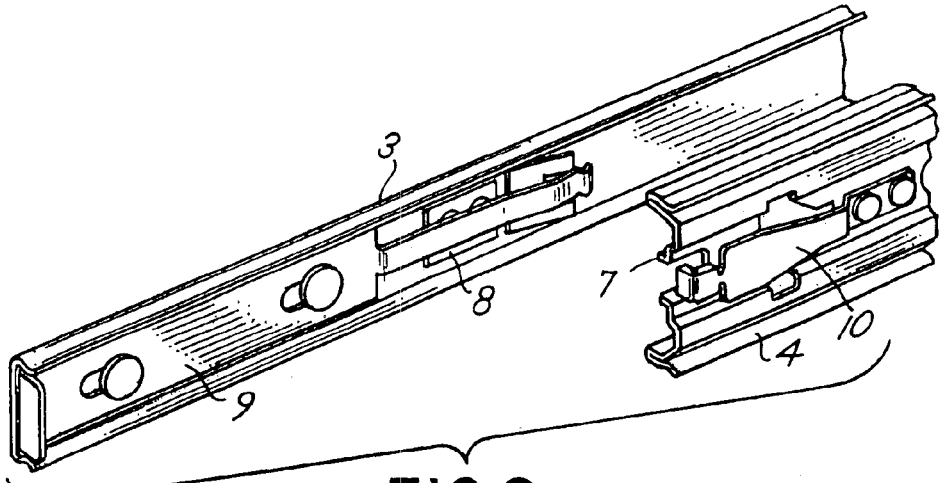
FIG.9

DRAWER SLIDE LATCH AND RELEASE MECHANISM

CROSS REFERENCE TO RELATED APPLICATION

This is a utility application based upon provisional application Ser. No. 60/401,906 filed Aug. 8, 2002, entitled "Drawer Slide Latch and Release Mechanism", which is incorporated herewith by reference and for which priority is claimed.

BACKGROUND OF THE INVENTION

In a principal aspect, the invention relates to an improvement in locking systems for drawer support slides of the type used for drawers, particularly drawers that may contain electronic and industrial equipment.

Drawer support slides designed for use with drawers of a cabinet or for a slidable computer support platform desirably enable the drawer or platform to be locked in the extended or fully open position by means of a locking system incorporated in the slide. Prior art slides which utilize locking or latch mechanisms for locking telescoping drawer slide channels in the open or extended position could endanger the operator's fingers whilst the operator attempts to manually unlock the mechanism to permit drawer closure.

A design solution for this problem incorporates an actuator for release of the locking mechanism located at the front of the outermost extended drawer channel or slide element, clear of interfacing channels and the channel locking mechanism with its potential finger pinch points. Typical solutions are disclosed in U.S. Pat. No. 6,412,891 B1; U.S. Pat. No. 6,375,290 B1; U.S. Pat. No. 6,367,899 B1; and U.S. Publication U.S. 2002/0021061 A1, all incorporated herein by reference. Such prior art release mechanisms accomplish this objective, but risk override of travel stop features, since lock and disconnect functions are combined in a single latch mechanism release lever.

SUMMARY OF THE INVENTION

Briefly, the present invention comprises a first drawer slide channel longitudinally slidable in a second drawer channel between a fully retracted position associated with positioning a drawer in or toward the closed position and a fully extended position associated with positioning of the drawer in or toward the open position. A first cantilever spring is mounted on the first channel and has a stop edge or surface at the free end of the spring, which is biased into the pathway of the second channel when the first channel is extended. To release or disengage the first cantilever spring from engaging with the second channel and thus limiting telescopic movement, a longitudinally slidable release bar mounted on the first channel may be manually translated against the first cantilever spring member thereby depressing the spring member and moving it out of the pathway of the second channel.

The locking mechanism may further include a second cantilever spring, mounted on the first channel separate from the first spring, which includes a free end that also is positioned to engage the second channel thereby limiting the extent of telescopic outward extension of the first channel relative to the second channel. A third spring biased actuator is mounted on the second channel which, when manually depressed, will effect engagement with and release of both the first and second cantilever springs from restricting relative telescopic movement of both channels.

Thus, it is an object of the invention to provide an improved mechanism for locking a drawer slide channel in an extended position automatically upon movement to that extended position, and for manual actuation release from being in the locked position in a manner which is relatively safe to the manual operator.

These and other objects, advantages and features of the invention will be set forth in the detailed description which follows.

BRIEF DESCRIPTION OF THE DRAWING

In the detailed description which follows the reference will be made to the drawing comprised of the following figures:

FIG. 8 is an isometric view of a drawer slide of the invention incorporated with a drawer; and FIG. 9 is an exploded view of the drawer slide configuration of FIG. 8.

DESCRIPTION OF THE PREFERRED EMBODIMENT

Figures 1, 2:
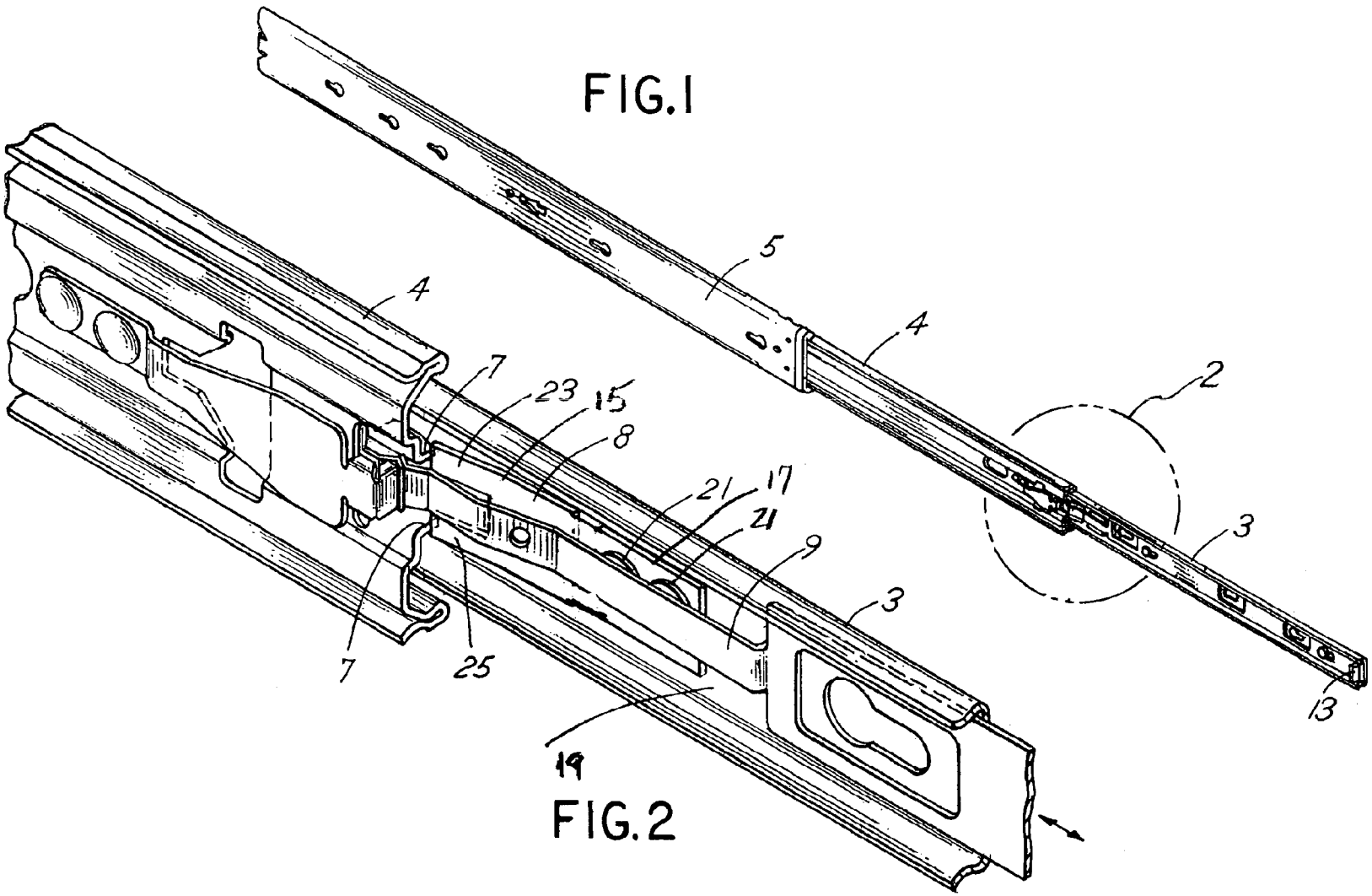
FIG. 1 is an isometric view of a drawer slide comprised of multiple channels and incorporating the subject matter of the invention.
FIG. 2 is an enlarged isometric view of the drawer slide locking and release mechanism incorporated in the drawer slide assembly of FIG. 1.

Referring to the figures, a first or inner drawer slide channel 3 affixed to drawer 56 is slidable longitudinally in a second channel 4. The first channel 3 includes a cantilever spring member 8 which is attached to a center web or span 19 by rivets 21 at one end 17 to the inside of the first channel member 3 and between inner channel 3 and middle channel 4. The opposite end 15 of the cantilever spring member 8 extends in the direction toward the second channel 4, i.e. the direction of the arrow in FIG. 4 which is the direction of closure of first channel 3, and comprises first and second spaced, bifurcated arms 23 and 25, which are adapted to engage against spaced projecting lugs 7 depending from the second or inner channel 4 toward the web 19 of first channel 3. Thus upon full extension of the first channel 3 slidably outwardly in second channel 4 toward the open position, the ends 23 and 25 of the cantilever spring 8 will project or move away from the center web 19 of the channel member 3 and engage with or against the projections or lugs 7 of the channel 4, thereby preventing inward movement of the first channel 3 into the second channel 4. Outer channel 5 telescopically receives channels 3, 4 and may be attached to cabinet 54.

Figures 3, 3A, 4, 5, 6:
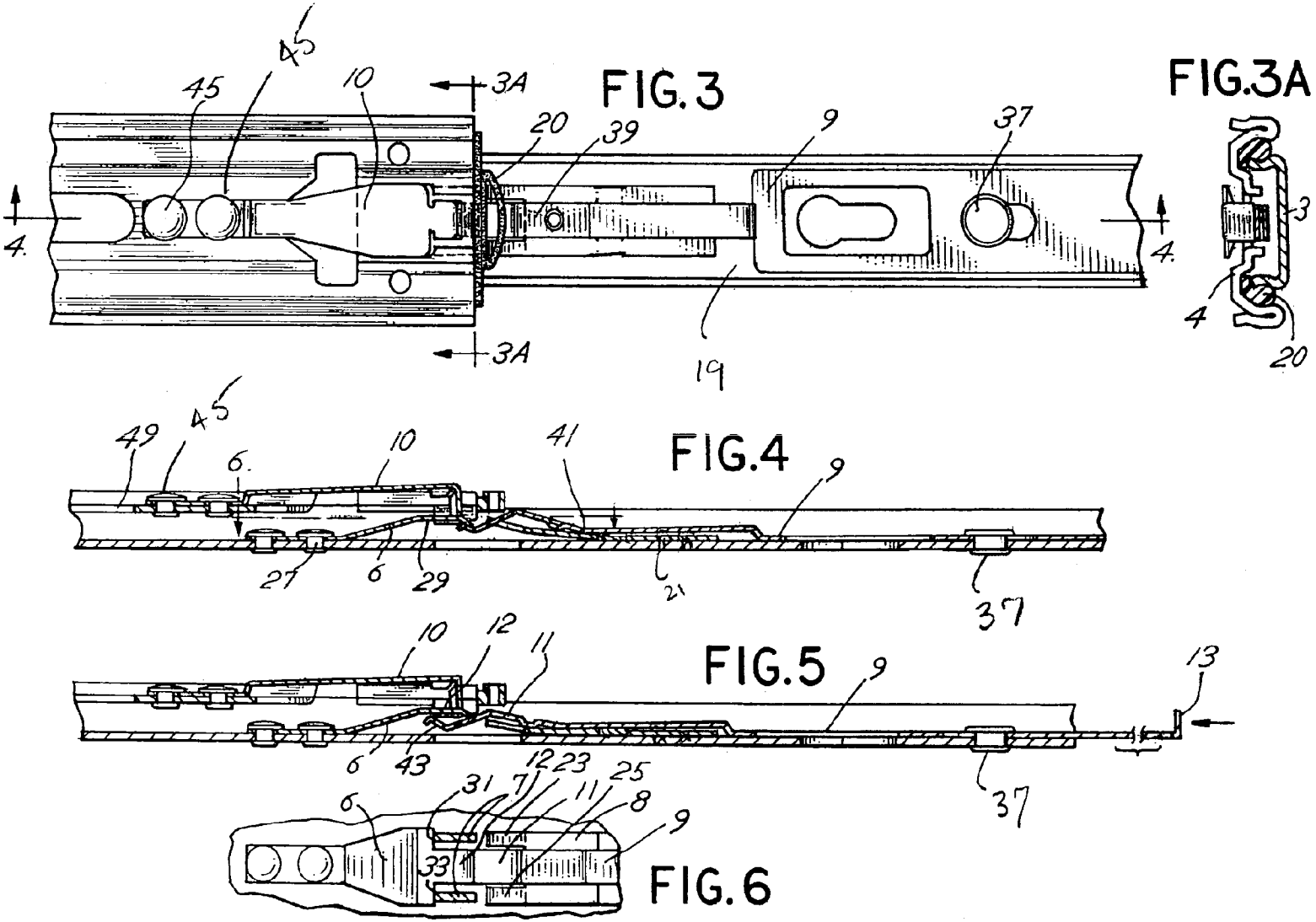
FIG. 3 is a plan view of the mechanism of FIG. 2.
FIG. 3A is a section view of FIG. 3 along the line 3—3.
FIG. 4 is a side cross-sectional view of the mechanism of FIG. 3 taken along the line 4—4.
FIG. 5 is a side cross-sectional view similar to FIG. 4, wherein the release mechanism for releasing a first channel relative to a second channel has been actuated.
FIG. 6 is a plan view of the release feature depicted in FIG. 5.
Figure 7:
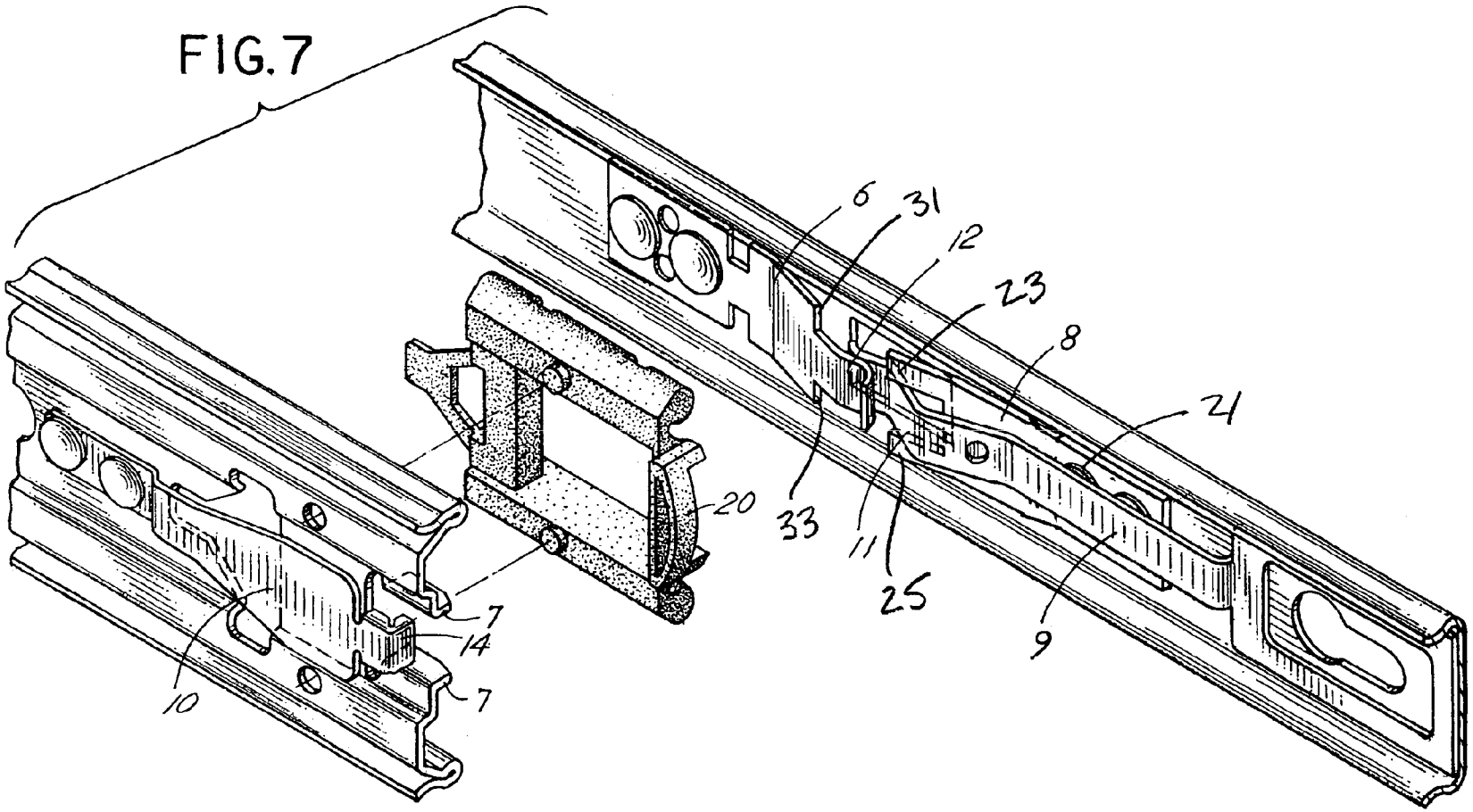
FIG. 7 is an exploded isometric view of the mechanism depicted in FIG. 2, further incorporating a bumper mechanism.

A second cantilever spring or latch member 6 is also attached by rivets 27 to the first or inner channel 3. The outwardly biased end 29 of the cantilever spring 6 extends toward the free end or outer end of first channel 3 and includes operative bifurcated edges 31 and 33 as shown in FIG. 6 which engage with the opposite side of projections or lugs 7 of second channel 4, again as depicted in FIG. 6, when the first channel 3 is moved toward the extended position within the second channel 4 there by limiting outward movement of first channel 3. Thus, as illustrated is FIG. 6, the first channel 3, when extended, is locked in position and cannot be moved inwardly inasmuch as the bifurcated arms or ends 23 and 25 of spring 8 engage with the lugs 7 and similarly, the first channel 3 cannot be moved further outwardly in the second channel 4 inasmuch as the edges 31 and 33 of spring 6 engage with the opposite side of the lugs 7. The outer channel or first channel 3 is thus maintained in a generally fixed, non-slidable position within the second channel 4.

To effect release of the first channel 3 so that it may be moved inwardly within the second channel 4 toward the closed position, a latch release lever comprised of a planar plate member 9 is slidable on headed mounting rivets, such as rivet 37, in the channel 3 longitudinally along web 19. A manual-actuating tab 13 is provided at the outer end of the release latch 9. The opposite or inner end of the release latch 9 rides or slides over the spring 8 and comprises a cantilever spring member 39 which includes a bend or rib 41 that engages against the cantilever spring 8 when latch 9 is moved slidably toward the second channel 4 in the direction of the arrow in FIG. 4 thereby forcing spring 8 downwardly toward web or span 19 to release the arms 23 and 25 from engagement with the projections or tabs 7. Channel 3 is then slidable inwardly.

Further, inward movement of the latch member 9 causes an end tab 43 of spring member 39 of the latch 9 to engage against the underside of the cantilever spring 6 forcing it upwardly thereby insuring that it remains in position to engage the projections 7 and thus prevent removal of the first channel 3 from the second channel 4 outwardly.

In order to effect total outward sliding removal of the first channel 3 from the second channel 4 for repair, replacement or the like, an auxiliary control latch or latch spring member 10 is provided. The control latch 10 is mounted by means of rivets 45 which engage and hold the latch spring member 10 in position on the web or central section 49 of second channel 4. The latch spring member 10 includes an active end 14 which, when latch 10 is depressed, will initially engage against the outer end 29 of the cantilever spring 6 mounted on the first channel member. This will permit disengagement of the spring 6 from the projections 7 thereby enabling release of the first channel member 3 from the second channel member 4 and removal therefrom. Additional depression of the spring member 10 mounted on the second channel member 4 provides an auxiliary means for also disengaging the cantilever spring 8 active ends 23 and 25 from the projections 7. That is, inasmuch as the active end 29 of the first spring 6 overlies the end member 11 of the latch 9, depression of the latch 10 will cause the end 29 of the spring 6 to engage the end of the spring 11, thereby deflecting both the spring members 6, 8 and releasing both spring members 6, 8 from engagement with the projections 7. Thus, the spring member 10 serves as an auxiliary mechanism for totally releasing the first channel 3 from engagement with the second channel 4. The auxiliary mechanism and latch 10 is devoid of pinch points and thus provides a safe release mechanism. Similarly, when releasing the first channel 3 for inward movement into the second channel 4, engaging the manual tab or latch member 13 at outer end of latch 9 provides a safe means for release without exposing the operator to a pinch point.

As another feature of the invention it is to be noted that upon full movement of the first channel 3 toward the closed position into the second channel 4, the latch or tab 13 of planar member 9 will engage against an elastomeric bumper 20 inserted in the end of the second channel 4 thereby accomplishing at least two functions. First the elastomeric bumper 20 provides a cushioning effect avoiding noise and cushioning the closure of the drawer. Secondly, the latch member 13 resets the latch member 9 inasmuch as the latch member 9 is moved to its full outward extension position when engaged by the elastomeric bumper 20.

While there has been set forth a preferred embodiment of the invention it is to be understood that the invention is limited only by the following claims and equivalents thereof.

What is claimed is:

1. A latch and release mechanism for a drawer slide comprising, in combination;

a first slide channel with a web section;

a second slide channel slidably receiving the first channel for movement longitudinally between a projected, open position and a retracted position;

a first cantilever spring member mounted on the first channel and including a first end attached to the first channel and a second free end spaced from the first channel web section;

a stop lug on the second channel projecting into a pathway of the free end of the first spring member for engagement by the first spring free end upon movement of the first channel to the open position to prevent movement of the first channel to said retracted position;

a cantilever spring release lever slidably mounted on the first channel and having a first manual activation outer end and a second inner first spring member engaging end, said release lever slidable to engage the activation end against the first spring member engaging end to move the first spring member out of engagement with the stop lug in said pathway;

a second cantilever spring member mounted on the first channel web section, said second spring member having a free end projecting toward the first spring free end and into the pathway for engaging said stop lug and limiting the sliding movement of the first slide channel toward the open position and in combination with the first cantilever spring member maintaining the first and second channels in a substantially fixed, non-slidable position; and an auxiliary spring release member mounted on the second channel for manual engagement simultaneously with the first and second cantilever spring members to move the first and second spring members from the pathway position for engaging the stop lug.

2. The mechanism according to claim 1 wherein the first and second spring members are flexible, thin, metallic elements.

3. The mechanism according to claim 1 wherein the auxiliary spring member is a thin, metallic, cantilever element attached to the second channel.

4. The mechanism according to claim 1 further including a projecting tab on the release lever, and a bumper element on the second channel for engaging the projecting tab upon movement of the second channel toward the retracted position to reset the release lever to its ready position for engagement with the stop lug when the slide assembly is closed.

* * * * *